US006609783B1

(12) United States Patent
Koyama et al.

(10) Patent No.: US 6,609,783 B1
(45) **Date of Patent: *Aug. 26, 2003**

(54) INK JET RECORDING HEAD, METHOD FOR PRODUCING THE SAME AND RECORDING APPARATUS EQUIPPED WITH THE SAME

(75) Inventors: Shuji Koyama, Kawasaki (JP); Masashi Kitani, Yokohama (JP); Toshihiro Mori, Yokohama (JP); Teruo Ozaki, Yokohama (JP); Masahiko Kubota, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/191,535

(22) Filed: Nov. 13, 1998

(30) Foreign Application Priority Data

| | | |
|---|---|---|
| Nov. 14, 1997 | (JP) | 9-313755 |
| Jan. 7, 1998 | (JP) | 10-001803 |
| May 27, 1998 | (JP) | 10-145768 |
| Nov. 12, 1998 | (JP) | 10-322429 |

(51) Int. Cl.[7] ..... B41J 2/05
(52) U.S. Cl. ..... 347/58; 29/890.1
(58) Field of Search ..... 347/58, 63, 56, 347/59; 29/890.1; 438/21

(56) References Cited

U.S. PATENT DOCUMENTS

| | | | | |
|---|---|---|---|---|
| 4,596,994 A | * | 6/1986 | Matsuda et al. | 347/64 |
| 4,635,073 A | * | 1/1987 | Hanson | 347/50 |
| 4,661,827 A | | 4/1987 | Sawai et al. | 347/204 |
| 4,947,191 A | | 8/1990 | Nozawa et al. | 347/30 |
| 5,006,867 A | | 4/1991 | Koizumi et al. | 347/17 |
| 5,081,474 A | | 1/1992 | Shibata et al. | 347/59 |
| 5,157,418 A | * | 10/1992 | Tamura | 347/54 |
| 5,157,419 A | * | 10/1992 | Matsumoto et al. | 347/59 |
| 5,252,988 A | * | 10/1993 | Katayama et al. | 347/205 |
| 5,311,218 A | * | 5/1994 | Ochiai et al. | 347/71 |
| 5,347,713 A | | 9/1994 | Shibata et al. | 29/890.1 |
| 5,479,197 A | | 12/1995 | Fujikawa et al. | 347/63 |
| 5,489,750 A | | 2/1996 | Sakemi et al. | 174/261 |
| 5,491,505 A | | 2/1996 | Suzuki et al. | 347/203 |
| 5,492,863 A | | 2/1996 | Higgins, III | 437/183 |
| 5,580,468 A | | 12/1996 | Fujikawa et al. | 216/27 |
| 5,812,162 A | * | 9/1998 | Silverbrook | 347/58 |
| 5,933,163 A | | 8/1999 | Koizumi et al. | 347/42 |
| 5,940,957 A | | 8/1999 | Goto et al. | 29/611 |

FOREIGN PATENT DOCUMENTS

| | | | |
|---|---|---|---|
| JP | 54107671 A | * | 8/1979 |
| JP | 63-312658 | | 12/1988 |
| JP | 403141673 A | * | 6/1991 |
| JP | 5-102143 | | 4/1993 |
| JP | 8-321506 | | 12/1996 |

* cited by examiner

*Primary Examiner*—Stephen D. Meier
*Assistant Examiner*—Blaise Mouttet
(74) *Attorney, Agent, or Firm*—Fitzpatrick, Cella, Harper & Scinto

(57) ABSTRACT

An ink jet recording head with a heat-generating resistance layer for generating thermal energy used for ink discharge, and a wiring electrode layer electrically connected to the heat-generating resistance layer to form an electro-thermal converting element, an insulating protective layer covering the electro-thermal converting element, and an external electrical connection portion electrically connected to the electro-thermal converting element and configured to connect to an external wiring for applying a voltage to the electro-thermal converting element. Further, the external electrical connection portion is formed by a layer grown by electroless plating from the wiring electrode layer through a through hole formed in the insulating protective layer. The external electrical connection portion projects beyond the insulating protective layer and has a flat surface at the most extended projection of the external electrical connection portion.

14 Claims, 11 Drawing Sheets

INK JET RECORDING HEAD, METHOD FOR PRODUCING THE SAME AND RECORDING APPARATUS EQUIPPED WITH THE SAME

BACKGROUND OF THE INVENTION

1. Field of the Invention

The present invention relates to an ink jet recording head, a method for producing the same and a recording apparatus equipped therewith.

2. Related Background Art

The ink jet recording method, forming a record by generating small ink droplets and depositing such droplets onto a recording material such as paper, is featured by extremely low noise at the recording operation, ability of achieving high-speed recording and ability of recording on plain paper. Among such ink jet recording, particular attention is being paid to so-called bubble jet recording method utilizing an energy generating member for generating energy for ink discharge.

FIGS. 11A, 11B, 12A and 12B illustrate the representative film structure of a heater portion and an electric connection portion in the recording head for the above-mentioned bubble jet recording.

FIGS. 11A and 11B show a heater board 100 of the bubble jet recording head, connected by wire bonding to a substrate (wiring substrate) for receiving an electrical signal from the printer. On an Si substrate 101, there is formed a heat accumulation layer 102, on which formed are a heat-generating element (electrical resistance layer) 103 for generating the ink discharging energy and a wiring (wiring electrode layer) 104 for supplying the heat-generating element with the electrical signal, with thin film forming technology. The heater board 100 is completed by forming thereon an insulation film 105 and a cavitation layer 106. The electrical connection with the wiring substrate is achieved by bonding a wire 109, with a wire bonding device, to a contact pad 111 provided in a contact hole (through hole) 107 which is opened in the protective layer.

FIGS. 12A and 12B show another method of electrical connection in the bubble jet recording apparatus, in which an ink discharging element and a TAB tape are connected by the TAB method. On an Si substrate 101, there is formed a heat accumulation layer 102, on which formed are a heat-generating element 103 for generating the ink discharging energy and a wiring 104 for supplying the heat-generating element with the electrical signal, by thin film forming technology. On these layers, an insulation film 105 is formed, and a contact hole 107 is formed for electrically connecting the heat-generating wiring 104 with an electrical connection layer formed on top. Then a cavitation layer 106 and an electrical connection layer 110 are formed for example by sputtering, and an electrical connection pad 111 is formed by photolithographic method. The electrical connection is achieved by bonding the electrical connection pad 111 of the completed heater board 100 and a lead 112 of a TAB tape by a bonding device.

In case the electrical connection pad is positioned in a recessed part (through hole) as shown in FIGS. 11A and 11B, the pad area has to be made large in order that the bonding is not hindered by the surrounding layers (insulation layer etc.). However, the area of the electrical connection pad cannot be made large enough, because a large number of functional elements are positioned on the substrate of the ink jet recording head and also because the dimension of the recording head is made smaller in recent years. For this reason, there is adopted a method of forming a bump of a conductive material on the through hole, thereby forming the electrical connection pad higher than the surrounding insulation layer. In either of the electrical connecting methods mentioned above, the surface of the electrical connection pad is desirably not concave but provided with a sufficiently large flat area, in order to increase the adhesion strength of bonding. However, if the bump is formed on the pad portion for example by sputtering, the film of the bump follows the stepped surface shape of the through hole whereby the surface of the bump is recessed. On the other hand, in case the bump is formed by electroplating in the through hole, the electroplating has to be conducted after the through hole portion is covered with a conductive film of a high anticorrosive property such as TiW, in order to prevent that aluminum constituting the wiring electrode is dissolved in the electroplating operation. For this reason, the formed conductive film follows the stepped shape of the through hole also in this case, whereby the surface of the bump becomes recessed. Besides, in order to effect such electroplating operation, there has to be provided a current supplying wiring for electroplating, in a part of the wiring electrode or of the conductive film.

Also the surface of the electrical connection pad can be made flat by extending the wiring from the through hole to the end of the substrate as shown in FIGS. 12A and 12B, such configuration does not match the aforementioned tendency of compactization of the substrate.

In the recording head of the side shooter type, there can be adopted the TAB connection shown in FIGS. 12A and 12B, but such electrical connecting method based on TAB requires an additional gold layer by sputtering or evaporation on the electrical connection layer 110 on the substrate, in comparison with the conventional wire bonding method, thus leading to the following drawbacks of:

1) requiring additional apparatus for gold film formation and patterning;

2) requiring an additional mask for the additional patterning step; and 3) requiring a larger target for a large-sized wafer, with a significantly increased initial investment of the gold for such a target.

SUMMARY OF THE INVENTION

In consideration of the foregoing, an object of the present invention is to provide an ink jet recording head and a producing method therefor, enabling size reduction of the recording head and providing excellent reliability in the connection with the external wiring.

Another object of the present invention is to provide an ink jet recording head and a producing method therefor, based on an electrical connecting method capable of solving the above-mentioned drawbacks 1), 2) and 3) and applicable both to the edge shooter type and the side shooter type, with a high production yield, a high process throughput and a low cost.

The above-mentioned objects can be attained, according to the present invention, by an ink jet recording head provided with a heat-generating resistance layer for generating thermal energy used for ink discharge, and a wiring electrode layer electrically connected to the heat-generating resistance layer, also provided on a substrate with an electrothermal converting element, an insulating protective layer covering the electrothermal converting element, and an external electrical connection portion electrically connected to the electrothermal converting element and to be adhered to an external wiring for applying a voltage to the electrothermal converting element, wherein the external electrical connection portion is formed by a film grown by electroless plating from the wiring electrode layer through a through hole formed in the insulating protective layer. The above-mentioned ink jet recording head further includes the features that an anticavitation Ta layer is formed on the insulating protective layer, avoiding the position of the external electrical connection portion, that a photosensitive resin layer constituting walls of a liquid path is formed on the insulating protective layer, that the external wiring is constituted by a TAB tape, and that the substrate has a protruding portion between the external electrical connection portion and the end of the substrate.

According to the present invention, there is also provided a method for producing an ink jet recording head provided with a heat-generating resistance layer for generating thermal energy used for ink discharge, and a wiring electrode layer electrically connected to the heat-generating resistance layer, also provided on a substrate with an electrothermal converting element, an insulating protective layer covering the electrothermal converting element, and an external electrical connection portion electrically connected to the electrothermal converting element and to be adhered to an external wiring for applying a voltage to the electrothermal converting element, the method comprising a step of forming a through hole in the insulating protective layer thereby partially exposing the wiring electrode layer, and a step of growing a film from the exposed wiring electrode layer by electroless plating thereby forming the external electrical connection portion. The above-mentioned method for producing the ink jet recording head further includes the features that an anticavitation Ta layer is formed on the insulating protective layer, avoiding the position of the external electrical connection portion, that the step of forming the external electrical connection portion by electroless plating is conducted after providing a photosensitive resin layer constituting the walls of a liquid path on the insulating protective layer, that the step of forming the external electrical connection portion by electroless plating is conducted forming the Ta layer and anodizing the surface thereof, that the external wiring is constituted by a TAB tape, that the substrate has a protruding portion between the external electrical connection portion and the end of the substrate, and that the protruding portion is formed simultaneously with the formation of the photosensitive resin layer constituting the liquid path walls.

According to the present invention, there is further provided a recording apparatus comprising the above-mentioned ink jet recording head.

According to the present invention, since the electroless plated film constituting the external electrical connection portion is grown solely from the portion exposed in the through hole, the surface of the electroless plated film is not recessed but can provide a flat area, whereby high reliability in the adhesion with the external wiring can be secured in the ink jet recording head. Also such configuration is suitable for a compact ink jet recording head, since the external electrical connection portion need not be extended.

Furthermore, the film configuration employed in the conventional electrical connection by wire bonding can be adopted without change, and nickel and gold can be formed by mere immersion in plating liquid, solely on the aluminum portion exposed by opening the contact hole. Furthermore, the configuration of the present invention is applicable also to the ink jet recording head of the side shooter type, since the electrical connection can be achieved with the TAB tape.

DETAILED DESCRIPTION OF THE PREFERRED EMBODIMENTS

The present invention is featured, as explained in the foregoing, by a fact that a film formed by electroless plating is employed as the external electrical connection portion for connection with the external wiring.

The electroless plating means a method of plating a metal on the surface of a substance as in the electroplating, utilizing chemical replacement between metals and chemical reduction instead of electrical energy employed in the electroplating, and provides advantages of:

1) satisfactory adhesion of the formed film, with possibility of forming a thick uniform plating even on the surface of a complex shape;

2) forming a smooth film;

3) plating even on aluminum or stainless steel, and forming double films; and 4) not requiring the electrical equipment.

In the present invention, as the film can be directly grown by electroless plating from the wiring electrode layer exposed in the through hole, the surface of the formed film does not follow the shape of the through hole but can provide a flat portion.

The bath for electroless plating can be composed of three components, namely a metal salt, a reducing agent (sodium hypophosphite, anhydrous sodium sulfite, formalin or hydroquinone), and a buffer (formate or acetate salt).

EXAMPLE 1

Figure 1A:
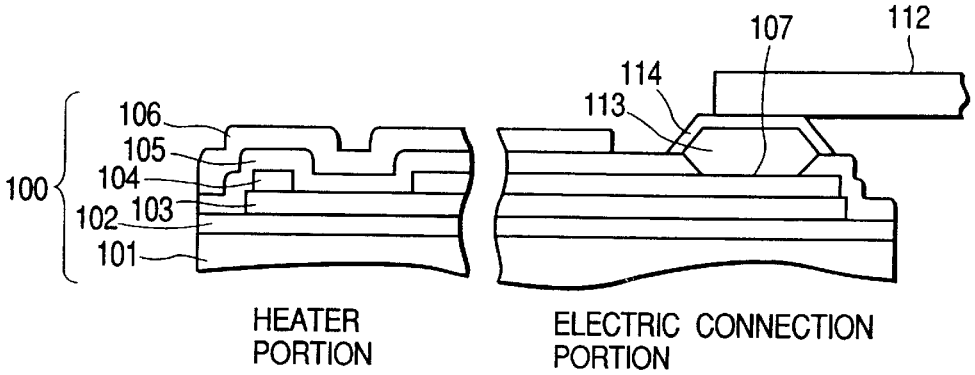
FIGS. 1A and 1B are respectively a cross-sectional view and a plan view of an ink jet recording head constituting a first embodiment of the present invention.
Figure 1B:
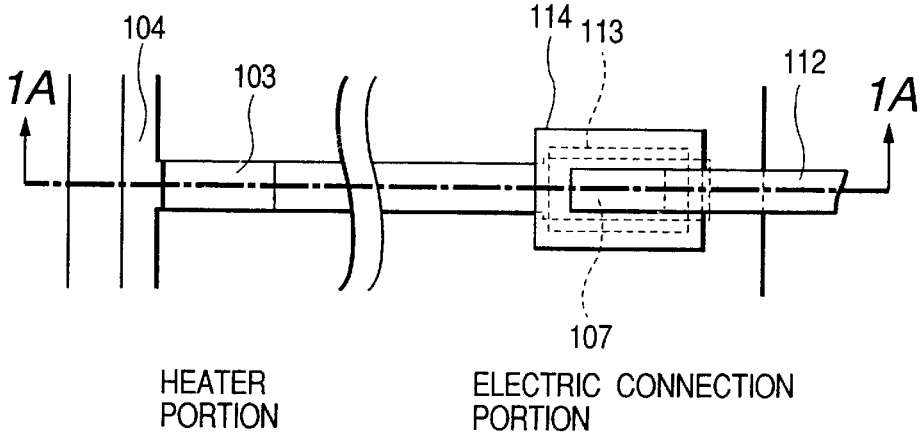

In the following the present invention will be explained in detail by an example thereof, with reference to FIGS. 1A and 1B.

At first, on a silicon substrate 101, a thermal oxide film 102 (silicon dioxide) is formed by thermal oxidation, and then a heat-generating element layer 103 (hafnium boride) and a wiring layer 104 (aluminum) are formed in succession by sputtering or evaporation. Then the heat-generating element layer 103 (hafnium boride) and the wiring layer 104 (aluminum) are patterned by a photolithographic process to form a heater and a wiring layer of a bubble jet head. Then an insulation film 105 (silicon dioxide or silicon nitride) is formed by CVD or sputtering and a cavitation film 106 (tantalum) is formed. (The insulation layer and the cavitation layer may be formed in continuation.) Then the cavitation film 106 (tantalum) and the insulation layer 105 (silicon dioxide or silicon nitride) are patterned by a photolithographic process to form a contact hole 107.

Then nickel and gold are formed by electroless plating in the contact hole 107. At first, etching is conducted for 20 seconds at room temperature, in order to remove the oxide film on the aluminum portion 104 in the contact hole 107. The etching solution consists of a mixture of ET-15 (40 ml per liter) and NS-APF (200 ml per liter), supplied by World Metal Co., and pure water (760 ml per liter). Then the wafer is immersed, for 30 seconds at 15° C., in catalyst. solution, consisting of a mixture of AT-100 (200 ml per liter) supplied by World Metal Co., and pure water (800 ml per liter). Subsequently the wafer is immersed for 5 minutes at 90° C. in nickel plating bath, consisting of a mixture of Rinden SA (200 ml per liter), supplied by World Metal Co., and pure water (800 ml per liter). Then the wafer is immersed for 30 minutes at 90° C. in gold plating bath, consisting of a mixture of MN-AUA2 (500 ml per liter), supplied by World Metal Co., gold potassium cyanide (6 g per liter) and pure water (500 ml per liter).

Such electroless plating provided a nickel 113 of 2 $\mu$m and a gold 114 of 0.4 $\mu$m in the part of the contact hole 107.

EXAMPLE 2

Figure 2A:
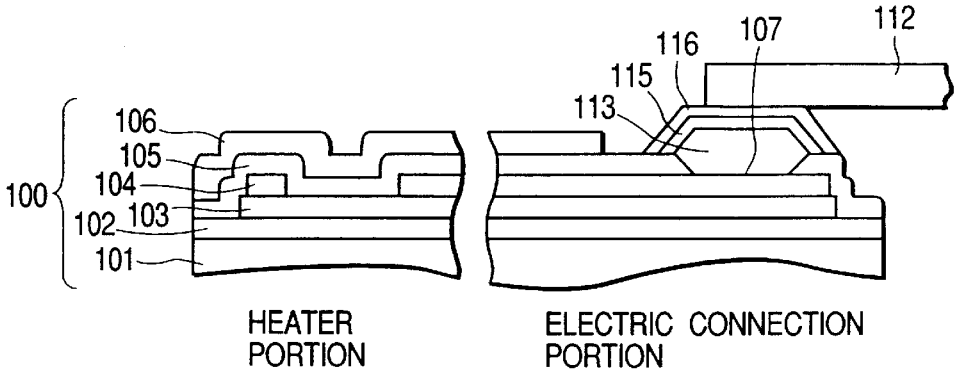
FIGS. 2A and 2B are respectively a cross-sectional view and a plan view of an ink jet recording head constituting a second embodiment of the present invention.
Figure 2B:
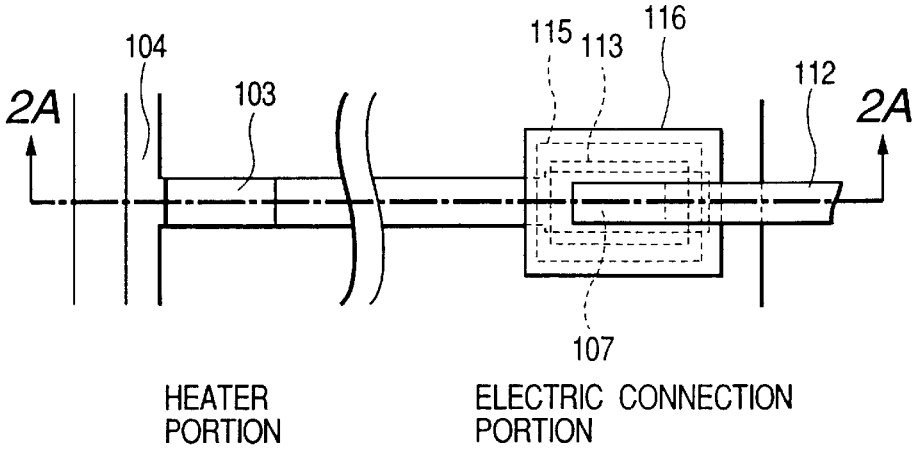

In the following there will be explained another example 2 with reference to FIGS. 2A and 2B.

In the present example, the process is same as that of the example 1 until the formation of the nickel. After the formation of the nickel, the wafer is immersed for 5 minutes at 90° C. in gold plating bath, consisting of a mixture of MN-AUA (500 ml per liter), supplied by World Metal Co., gold potassium cyanide (3 g per liter) and pure water (500 ml per liter).

Subsequently the wafer is immersed for 15 minutes at 75° C. in another gold plating bath, consisting of a mixture of GOLD-8 (500 ml of 8 M per liter and 5 g of 8A per liter), supplied by Sorld Metal Co., gold potassium cyanide (3 g per liter) and pure water (500 ml per liter).

Such electroless plating provided a nickel 113 of 2 $\mu$m, a gold-1 115 of 0.05 $\mu$m and a gold-2 116 of 0.5 $\mu$m in the part of the contact hole 107.

In the following there will be explained examples 3 to 5, showing a producing method for the ink jet recording head, capable of preventing abnormal plating that may occur if the layer for forming the above-described through hole has a pin hole, and also capable of improving the production yield.

EXAMPLE 3

In the following there will be explained an example of the present invention with reference to FIGS. 3A and 3B.

At first, on a silicon substrate 101, a thermal oxide film 102 (silicon dioxide) is formed by thermal oxidation, and then a heat-generating element layer 103 (hafnium boride) and a wiring layer 104 (aluminum) are formed in succession by sputtering or evaporation. Then the heat-generating element layer 103 (hafnium boride) and the wiring layer 104 (aluminum) are patterned by a photolithographic process to form a heater and a wiring layer of a bubble jet head.

Then an insulation film 105 (silicon dioxide or silicon nitride) is formed by CVD or sputtering, and a cavitation film 106 (tantalum) is formed. (The insulation layer and the cavitation layer may be formed in continuation.)

Then the cavitation film 106 (tantalum) and the insulation layer 105 (silicon dioxide or silicon nitride) are patterned by a photolithographic process to form a contact hole 107.

Then for forming a liquid path, a dry film photoresist is laminated on the substrate, exposed and developed. At first a dry film photoresist (DF) SY-337 (trade name of Tokyo Ohka Co.) is laminated with a laminator HRL-24 manufactured by Riston Co.

Figure 3A:
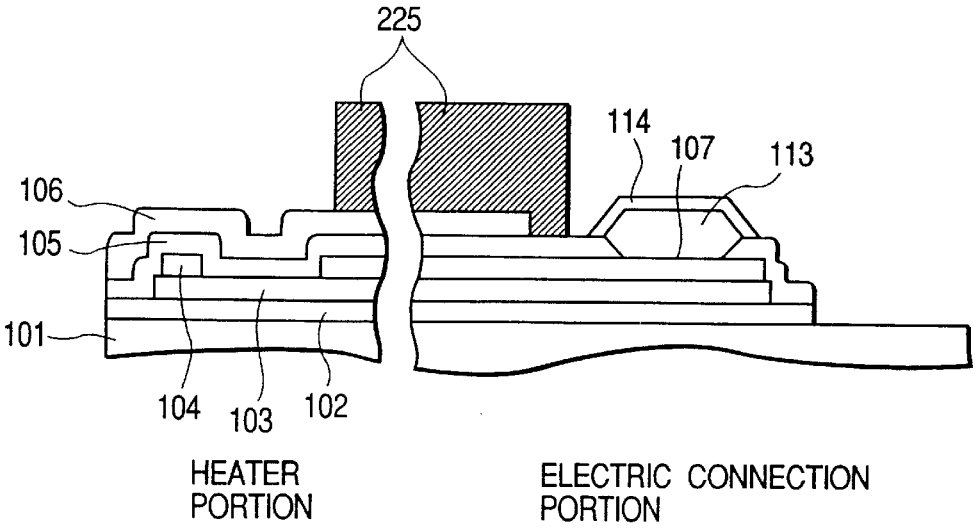
FIGS. 3A and 3B are respectively a cross-sectional view and a plan view of an ink jet recording head constituting a third embodiment of the present invention.
Figure 3B:
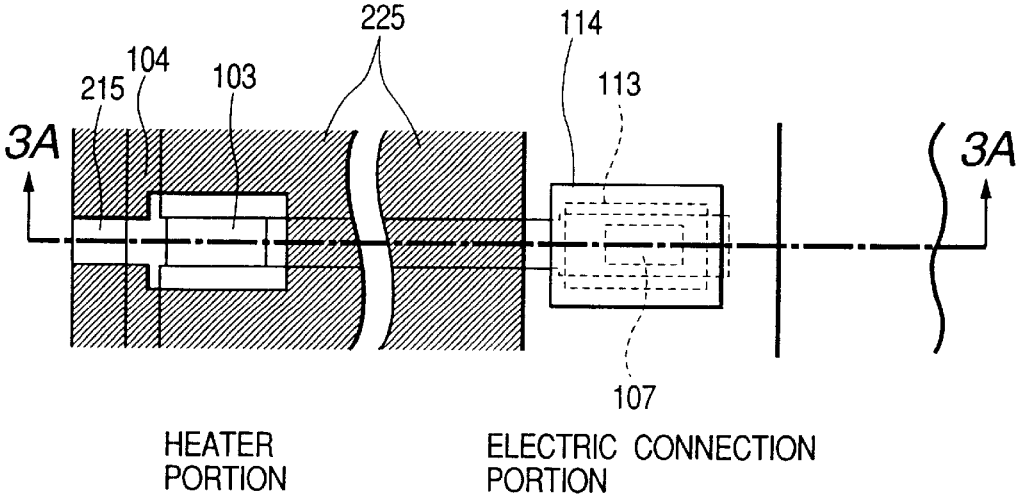
Figure 4A:
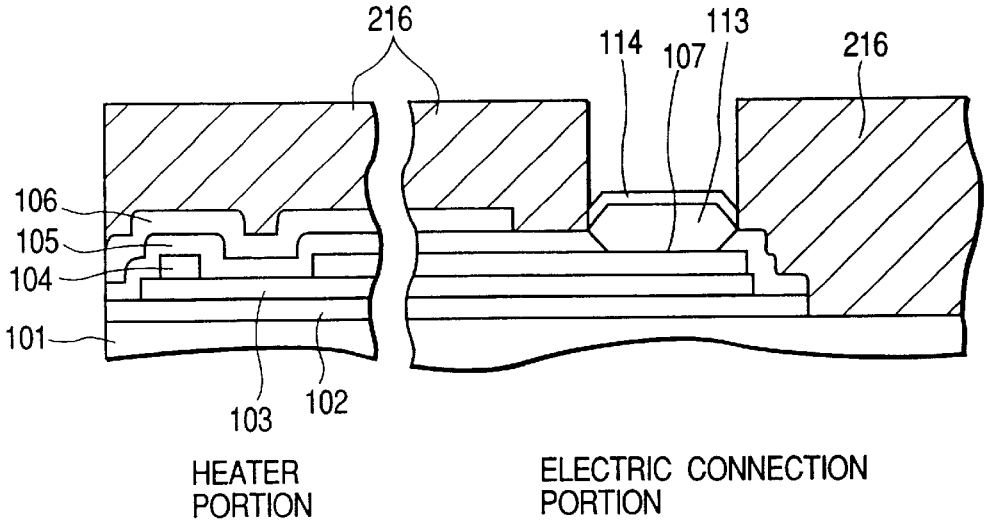
FIGS. 4A and 4B are respectively a cross-sectional view and a plan view of an ink jet recording head constituting a fourth embodiment of the present invention.
Figure 4B:
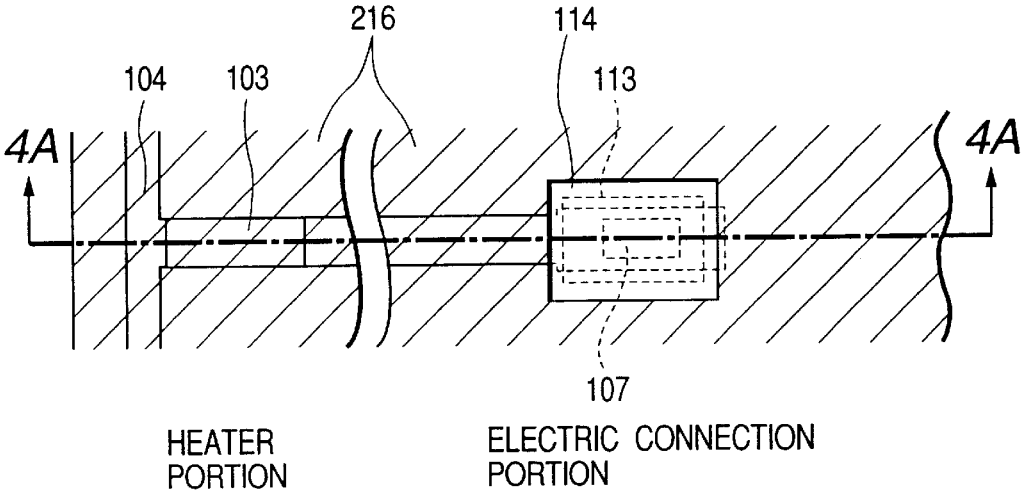

Then the dry film photoresist is exposed, through a photomask, with an exposure apparatus (PLA-600 manufactured by Canon K.K.), then is shower developed with BMR (trade name of Tokyo Ohaka Co.) which is a developer for SY-337, and post-baked for 1 hour at 150° C. to obtain a liquid path wall 225 as shown in FIGS. 3A and 3B.

Then nickel and gold are formed by electroless plating in the part of the contact hole 107. At first, etching is conducted for 20 seconds at room temperature, in order to remove the oxide film on the aluminum portion 104 in the contact hole 107. The etching solution consists of a mixture of ET-15 (40 ml per liter) and NS-APF (200 ml per liter), supplied by World Metal Co., and pure water (760 ml per liter). Then the wafer is immersed, for 30 seconds at 15° C., in catalyst solution, consisting of a mixture of AT-100 (200 ml per liter) supplied by World Metal Co., and pure water (800 ml per liter). Subsequently the wafer is immersed for 5 minutes at 90° C. in nickel plating bath, consisting of a mixture of Rinden SA (200 ml per liter), supplied by World Metal Co., and pure water (800 ml per liter). Then the wafer is immersed for 30 minutes at 90° C. in gold plating bath, consisting of a mixture of MN-AUA2 (500 ml per liter), supplied by World Metal Co., gold potassium cyanide (6 g per liter) and pure water (500 ml per liter).

Such electroless plating provided a nickel 113 of 2 $\mu$m and a gold 114 of 0.3 $\mu$m in the part of the contact hole 107, and abnormal plating of nickel or gold was not observed in the cavitation layer consisting of tantalum.

EXAMPLE 4

In the following there will be explained another example of the present invention with reference to FIGS. 4A, 4B, 5A and 5B.

In the present example, the process is same as that of the example 3 up to the patterning of the cavitation film.

Then the insulation film (silicon dioxide, silicon nitride or the like) 105 is patterned to form a contact hole. In the ordinary contact hole formation, a resist layer 216 is removed after the etching of the insulation layer, but, in the present example, the next plating of nickel and gold is executed without removing the resist layer 216.

The method of nickel and gold plating is same as that in the example 3.

The resist layer 216 consisted of PMER (trade name of Tokyo Ohka Co.) and was not attacked even after being treated with the etchant, activating liquid, nickeling liquid and gold plating (gilding) liquid.

The PMER is removed after the plating of nickel and gold.

Figure 5A:
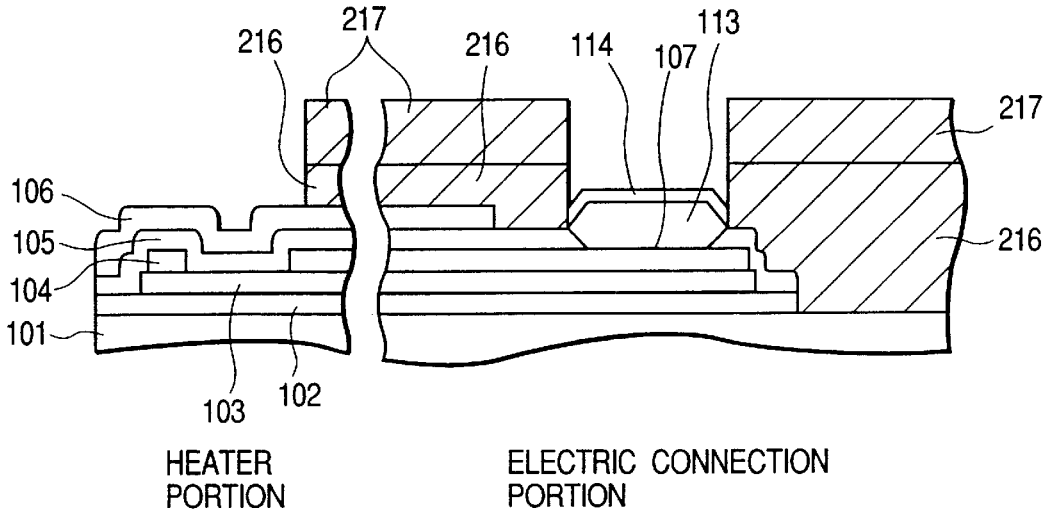
FIGS. 5A and 5B are respectively a cross-sectional view and a plan view of an ink jet recording head of the fourth embodiment of the present invention, employing two resist layers.
Figure 5B:
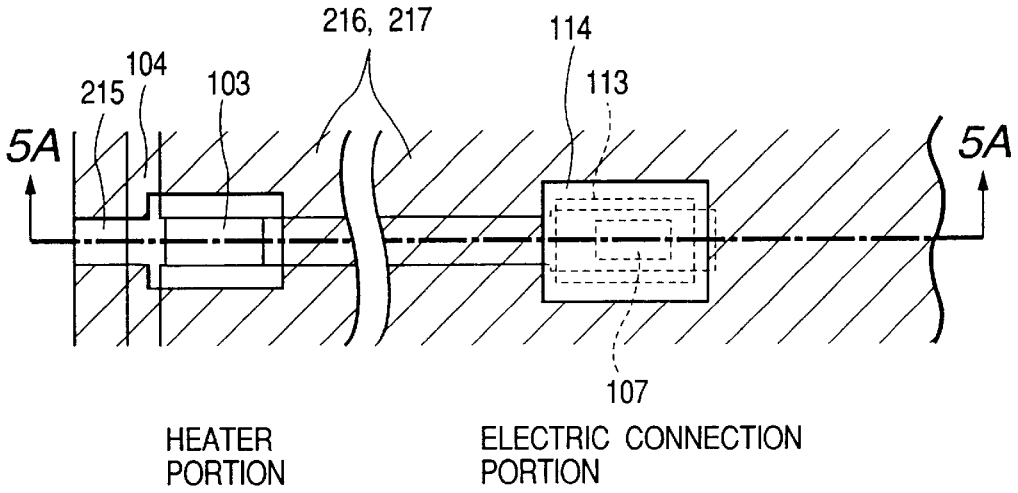

In case the PMER is not removed but is used as a protective film for the heater board, the resist 216 is removed only in the heater part. Such removal can be achieved, as shown in FIGS. 5A and 5B, by applying resist to the substrate again, patterning in such a manner that the resist b of 217 does not remain in the heater portion and the terminal portion, and ashing the resist a of 216 with oxygen plasma.

Such process provided a nickel 113 of 2 $\mu$m and a gold 114 of 0.3 $\mu$m in the part of the contact hole 107, and abnormal plating of nickel or gold was not observed in the metal layer (tantalum) of the cavitation layer.

Also similar results could be obtained by replacing the photoresists (216, 217) shown in FIGS. 4A, 4B, 5A and 5B with polyimide such as Photoniece (trade name of Toray Co.).

EXAMPLE 5

In the following there will be explained another example of the present invention in detail with reference to Table 1.

The present example provides a method of eliminating the pinholes in the protective film, for nickel and gold plating.

Table 1 shows the abnormality in plating (presence/absence of abnormality and its rate) as a function of means for eliminating the pinholes in the protective film.

Methods employed for eliminating the pinholes are listed in the following:

(1) Anodizing of wiring layer or cavitation (metal) layer:

At first there will be explained a method of eliminating the pinholes by anodizing of the wiring layer.

After the formation of the thermal oxide film on the silicon substrate, the heat-generating element layer 103 (hafnium boride) and the heat-generating element wiring layer 104 (aluminum) are formed in succession by sputtering or evaporation.

Then, prior to the patterning of the aluminum film, there is executed aluminum anodizing of a first step.

The substrate sputtered with aluminum is immersed in 10% aqueous solution of phosphoric acid, and a DC current at a voltage of 100 V is applied for 20 minutes, utilizing the aluminum as the anode. Then, as the treatment of a second step, the substrate is immersed in mixed aqueous solution containing boric acid (0.5 mol/liter) and sodium tetraborate (0.05 mol/liter), and a DC current at a voltage of 200 V is applied for 20 minutes, utilizing aluminum as the anode.

Aluminum on thus processed substrate showed alumina formation on the surface, under the observation with EPMA (X-ray microanalyzer) manufactured by Shimadzu Mfg. Co.

Then the heat-generating element 103 (hafnium boride) and the wiring layer 104 (aluminum) formed with alumina on the surface are patterned by a photolithographic process to form a heater and a wiring layer of a bubble jet head. In this operation, alumina on the wiring layer could be etched together with the wiring layer because such alumina was very thin.

Then an insulation film 105 (silicon dioxide or silicon nitride) is formed by CVD or sputtering, and a cavitation film 106 (tantalum) is formed. (The insulation layer and the cavitation layer may be formed in continuation.)

Then the cavitation film 106 (tantalum) and the insulation layer 105 (silicon dioxide or silicon nitride) are patterned by a photolithographic process to form a contact hole 107.

In this operation, even if the insulation film 105 (silicon dioxide or silicon nitride) contains pinholes, the cavitation layer 106 and the wiring layer 104 (aluminum) are not electrically connected because of the presence of enodized alumina on the heat-generating element wiring layer 104 (aluminum).

In the following there will be explained a method of eliminating the pinholes by anodizing of the cavitation layer.

After the formation of the thermal oxide film on the silicon substrate, the heat-generating element layer 103 (hafnium boride) and the wiring layer 104 (aluminum) are formed in succession by sputtering or evaporation.

Then the heat-generating element layer 103 (hafnium boride) and the heat-generating element wiring layer 104 (aluminum) formed with alumina on the surface are patterned by a photolithographic process to form a heater and a wiring layer of a bubble jet head. Then an insulation film 105 (silicon dioxide or silicon nitride) is formed by CVD or sputtering, and a cavitation film 106 (tantalum) is formed. (The insulation layer and the cavitation layer may be formed in continuation.)

Then, prior to the patterning of the tantalum film, there is executed tantalum anodizing of a first step.

The substrate subjected to tantalum sputtering is immersed in 10% aqueous solution of phosphoric acid, and a DC current of 100 V is applied for 20 minutes, utilizing tantalum as an anode. Then, as the treatment of a second step, it is immersed in mixed aqueous solution containing boric acid at 0.5 mol/liter and sodium tetraborate at 0.05 mol/liter and a DC current of 200 V is applied for 20 minutes, utilizing tantalum as an anode.

The substrate thus processed did not show abnormality in nickel and gold plating because the uppermost tantalum layer is rendered insulating by anodization, even if pinholes are present in the insulating layer to provide electroconductivity between the cavitation layer and the aluminum layer.

(2) Multi-layered structure in protective film:

The protective film is formed by a combination of silicon dioxide, silicon nitride and silicon carbide that the pinholes are generated in different locations.

Table 1 shows the results obtained with a three-layered protective film based on silicon dioxide, silicon nitride and silicon carbide, a two-layered protective film based on silicon dioxide and silicon nitride, and a two-layered protective film based on silicon nitride and silicon carbide. No abnormality was observed in nickel and gold plating, in any of these protective films.

(3) Organic film (silicon dioxide film forming application solution) on inorganic film (silicon dioxide or silicon nitride):

As a configuration containing an organic film on an inorganic film, Table 1 shows an example of applying OCD (trade name of Tokyo Ohka Co.; silicon dioxide film forming solution) to silicon dioxide and another example of coating OCD to silicon nitride. No abnormality was observed in nickel and gold plating in either case.

(4) Thickness change in single-layered protective film, in a range of 0.7 to 1.2 μm:

For eliminating the pinholes by the change of film thickness, Table 1 shows examples of film thickness change by a step of 0.1 μm in a range from 0.7 to 1.2 μm.

As shown in this table, abnormality was not observed in nickel and gold plating if the thickness of the protective film was 0.8 μm or larger.

The nickel plating and gold plating, conducted after elimination of the pinholes in the protective film by the above-described methods (1)–(4), did not show any abnormality in metal cavitation layer (tantalum) as shown in Table 1. (With respect to the method (4), no abnormality was observed in nickel plating and gold plating if the film thickness was 0.8 μm or larger.)

In the above-described configurations, if a lead of the TAB comes into contact with the substrate, an electric leak may be generated in such contact portion. Following examples 6 and 7 show configurations for preventing the lead of the TAB from contacting the substrate.

EXAMPLE 6

Figure 6A:
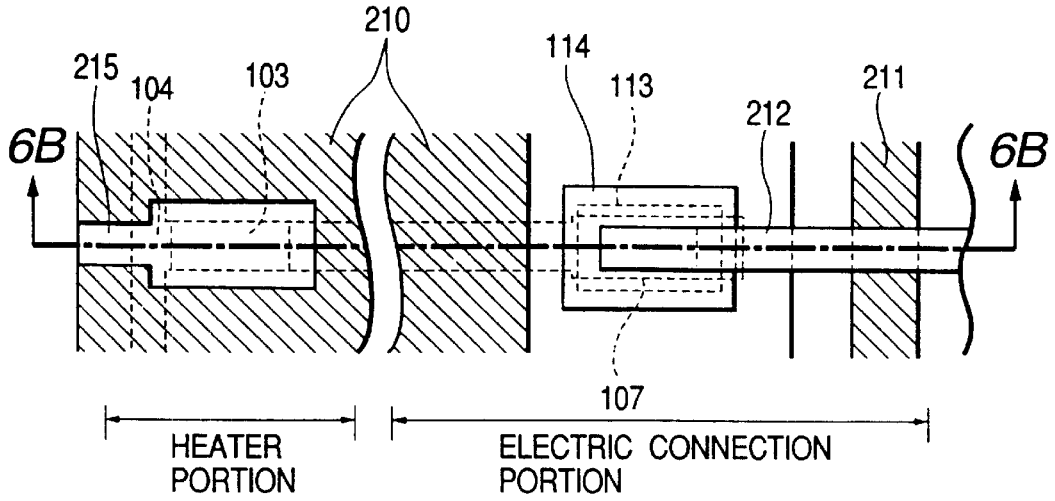
FIGS. 6A and 6B are respectively a plan view and a cross-sectional view along a line 6B—6B in FIG. 6A, showing the representative film configuration of a heater portion and an electrical connecting portion on a substrate to be employed in the ink jet recording head of a sixth embodiment of the present invention.
Figure 6B:
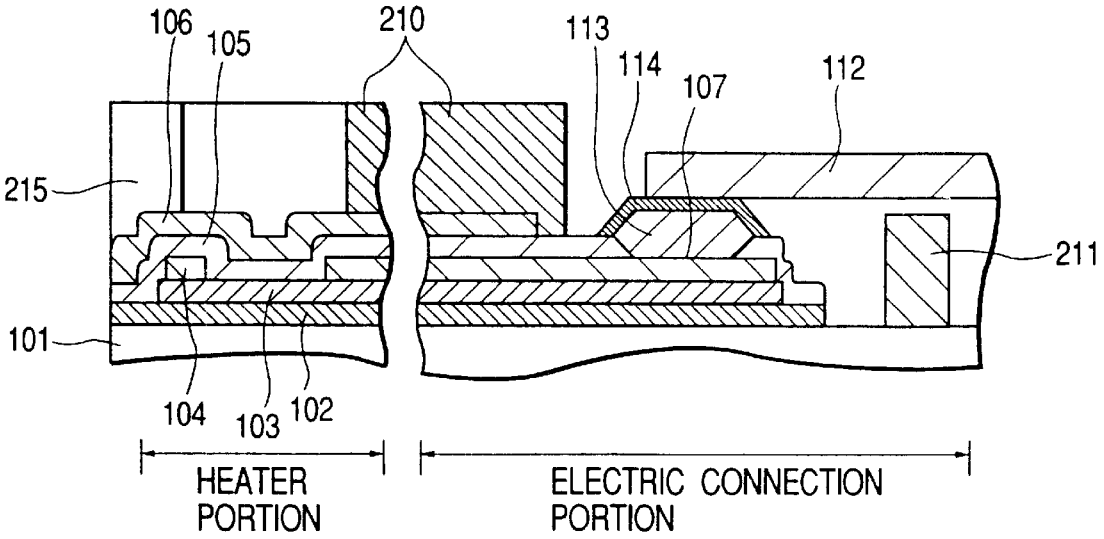

FIGS. 6A and 6B are respectively a plan view and a cross-sectional view along a line 6B—6B in FIG. 6A, showing the film configuration of a heater portion and an electrical connection portion on a substrate to be employed in an ink jet recording head of an example 6.

The ink jet recording head of this example is provided, as shown in FIGS. 6A and 6B, with a projection 211 between a lead 112 of a TAB substrate (not shown) for receiving electrical signals from the main body of the recording apparatus and the end face of a silicon substrate (hereinafter written as Si substrate) 101 constituting the substrate of the recording head. The head substrate is provided with a heater portion for generating thermal energy for ink discharge, and an electrical connection portion for connecting the heater portion with the lead 112.

In the following there will be explained a method for producing the ink jet recording head described above.

At first, on an Si substrate 101 constituting a base of the substrate for the recording head, a thermal oxide film (silicon dioxide) is formed as a heat accumulation layer 102 by thermal oxidation, and then a heat-generating element layer 103 (hafnium boride) and a heat-generating element wiring layer 104 (aluminum) are formed in succession by sputtering or evaporation. Then the heat-generating element layer 103 (hafnium boride) and the wiring layer 104 (aluminum) are patterned by a photolithographic process to form a heater and a wiring layer of an ink jet recording head. Then an insulation film 105 (silicon dioxide or silicon nitride) is formed by CVD method or sputtering so as to cover the heat-generating element 103 and the wiring 104, and a cavitation film 106 (tantalum) is formed. The insulation layer 105 and the cavitation layer 106 may be formed in continuation. Then, after the cavitation film 106 (tantalum) and the insulation layer 105 (silicon dioxide or silicon nitride) are patterned by a photolithographic process a contact hole 107 is opened in the insulation layer 105 for exposing the wiring 104.

Then, in order to form an electrical connection portion between the wiring 104 connected to the heater portion and the TAB lead 112, nickel and gold are layered in succession by electroless plating in the contact hole 107 thereby forming a bonding pad.

Then, on the recording head substrate, already subjected to the formation of the bonding pad, there is formed an ink path 215 and a projection 211. On the substrate subjected to the formation of the bonding pad as explained in the foregoing, a dry film, which is a photosensitive resin (trade name SY-325 manufactured by Tokyo Ohka Co.) of a thickness of 25 μm, is laminated with a laminator (model HRL-24 supplied by Riston Co.). The film thickness is suitably varied in such a manner that it does not exceed the height of the bonding pad from the surface of the Si substrate 101 of the base.

Subsequently, portions of the dry film 210 where the ink path 215 is not to be formed and where the projection 211 is to be formed are exposed to light, utilizing a photomask and an exposure apparatus (model MPA-600FA supplied by Canon K.K.). The portion of the dry film to be exposed for forming the projection 211 can be any area between the TAB lead 112 and the substrate.

Then the exposed dry film is developed with developer (trade name BMR, manufactured by Tokyo Ohka Co.). Since the dry film is a resist of negative type, the unexposed portion is dissolved while the exposed portions remain as shown in FIGS. 1A and 1B.

In this manner the recording head substrate with the ink path 215 and the projection 211 can be completed, without any electric leak and with a high projection yield.

EXAMPLE 7

Figure 7A:
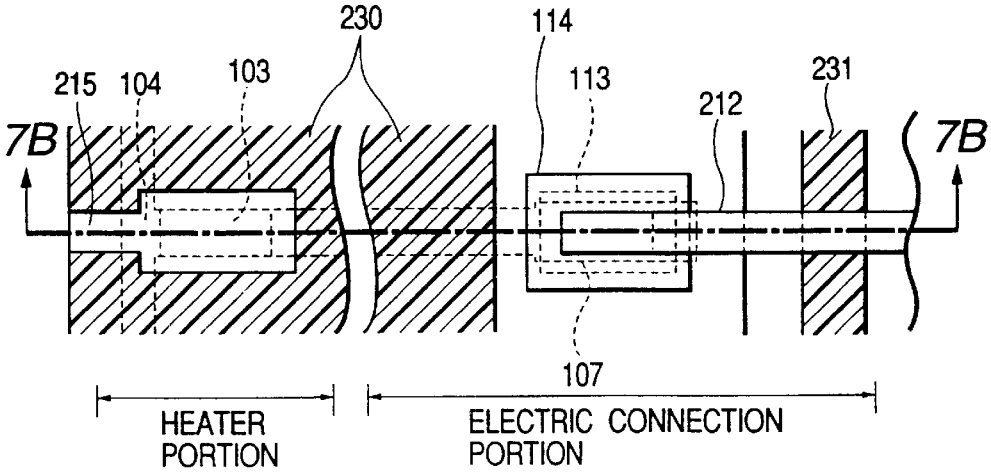
FIGS. 7A and 7B are respectively a plan view and a cross-sectional view along a line 7B—7B in FIG. 7A, showing the representative film configuration of a heater portion and an electrical connecting portion on a substrate to be employed in the ink jet recording head of a seventh embodiment of the present invention.
Figure 7B:
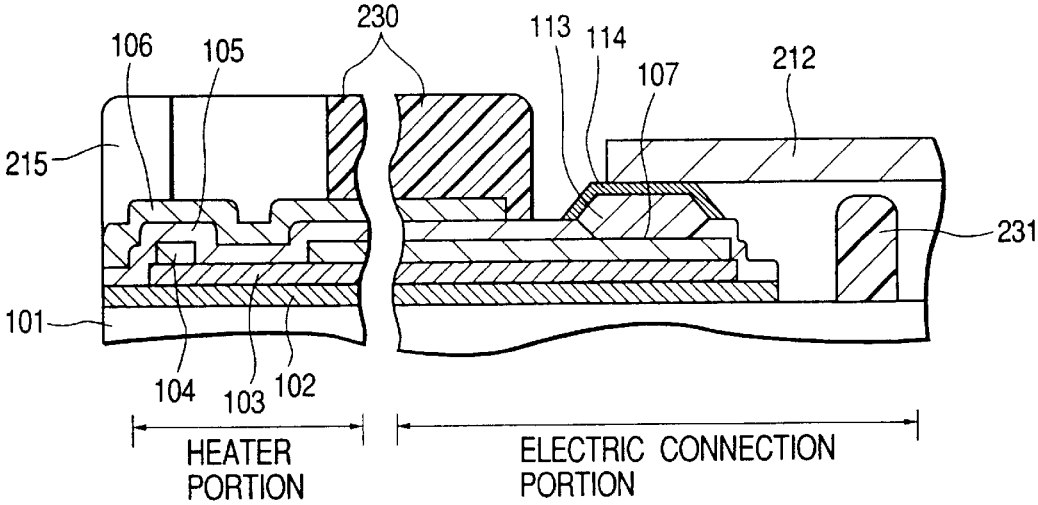

FIGS. 7A and 7B are respectively a plan view and a cross-sectional view along a line 7B—7B in FIG. 7A, showing the film configuration of a heater portion and an electrical connection portion on a substrate to be employed in an ink jet recording head of an example 7. In these drawings, components same as those in the example 6 are represented by same numbers.

The ink jet recording head of this example is same in configuration as that of the example 6, and the producing method is same as that of the example 6 until the formation of the gold bonding pad on the substrate.

In the present example, the formation of the ink path and the projection on the recording head substrate already bearing the gold bonding pad is achieved by a method different from that of the example 6. On the substrate subjected to the formation of the bonding pad as explained in the foregoing, positive resist, which is a photosensitive resin (trade name PMER manufactured by Tokyo Ohka Co.), is applied with a spinner.

Subsequently, portions of the positive resist 230 excluding areas where the ink path 215 is not to be formed and where the projection 231 is to be formed are exposed to light, utilizing a photomask and an exposure apparatus (model MPA-600FA supplied by Canon K.K.).

Then the exposed dry film is developed with developer (trade name P-6G, manufactured by Tokyo Ohka Co.). Since the resist is positive working type, the exposed portion is dissolved while the unexposed portions remain as shown in FIGS. 7A and 7B.

In this manner the recording head substrate with the ink path 215 and the projection 211 can be completed, without any electric leak and with a high projection yield.

Each of the heater boards (substrates for the ink jet recording head) of the examples 1 to 7 was bonded by the TAB lead by a manual bonder supplied by West Bond Co., and the adhesion strength between the TAB lead and the heater board was measured by a tensile tester. The tensile strength was satisfactorily high, in excess of 40 g in all the specimens.

Figure 8:
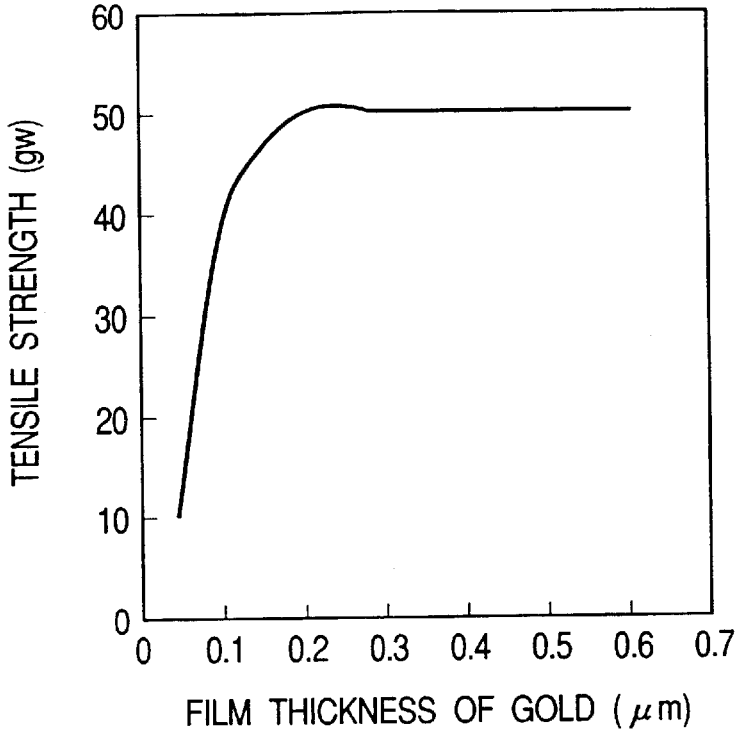
FIG. 8 is a chart showing the relationship between the film thickness of the gold in the ink jet recording head and the strength of TAB.

FIG. 8 shows the relationship between the thickness of the gold plated film in the electrical bonding pad and the tensile strength. As will be apparent from FIG. 8, the thickness of the gold plated film is preferably 0.1 μm or larger. Further, although aluminum is employed for the wiring layer in the embodiments, plating can be conducted to the electric connection portion even if aluminum alloys such as aluminum-silicon, aluminum-copper and aluminum-copper-silicon may be employed.

Figure 9:
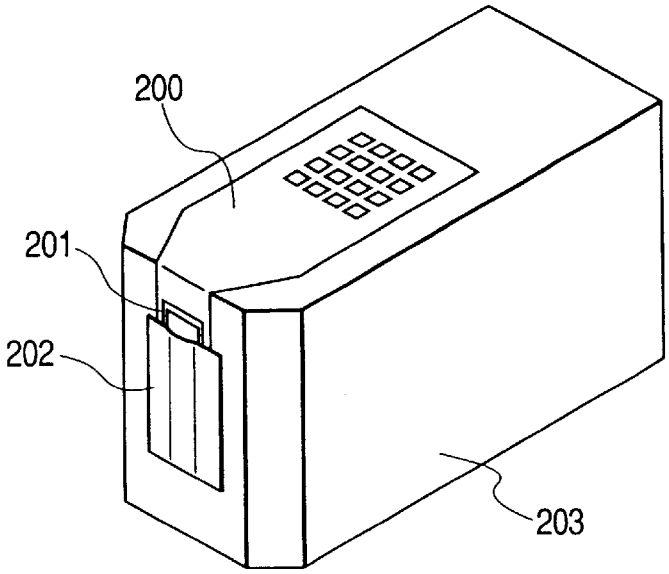
FIG. 9 is a schematic view of an ink jet recording head of side shooter type embodying the present invention.

FIG. 9 shows an ink jet head of side-shooter type, embodying the present invention, wherein shown are a TAB tape 200, an electrical connection portion 201, an orifice plate 202 including discharge ports, and an ink tank 203. The heater board 100 of the present invention is positioned under the orifice plate 202. After the formation of the ink paths by a dry film or the like on the heater board 100, the orifice plate 202 is adhered thereon, and is then adhered to the ink tank 203 on which the TAB tape 200 is adhered in advance. Then electrical bonding is executed, and the electrical connection portion 201 of the TAB tape 200 is sealed with a sealant to complete the ink jet head of the side-shooter type.

Figure 10:
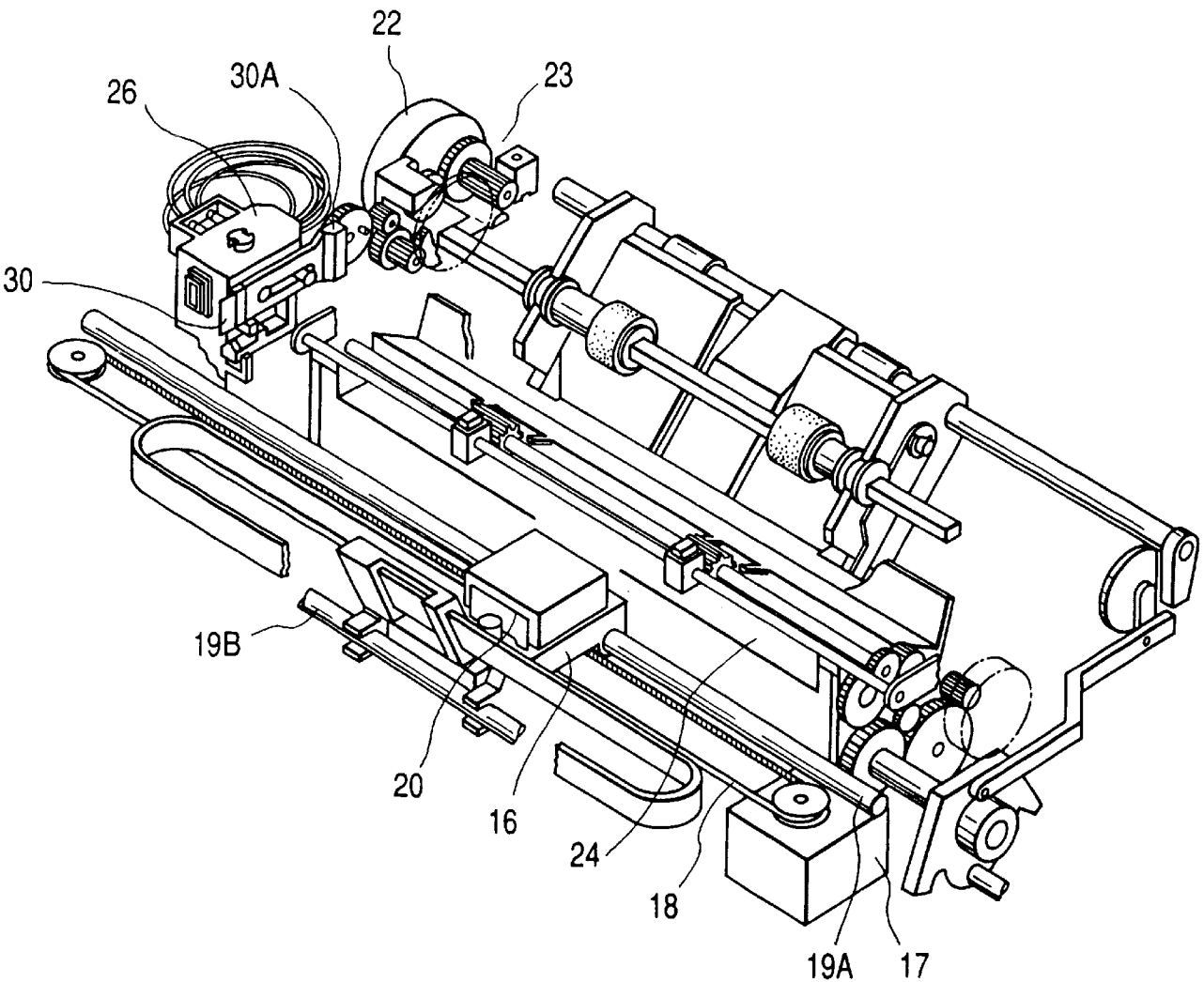
FIG. 10 is an external perspective view of an ink jet recording apparatus in which an ink jet head embodying the present invention is mounted as an ink jet cartridge.
Figure 11A:
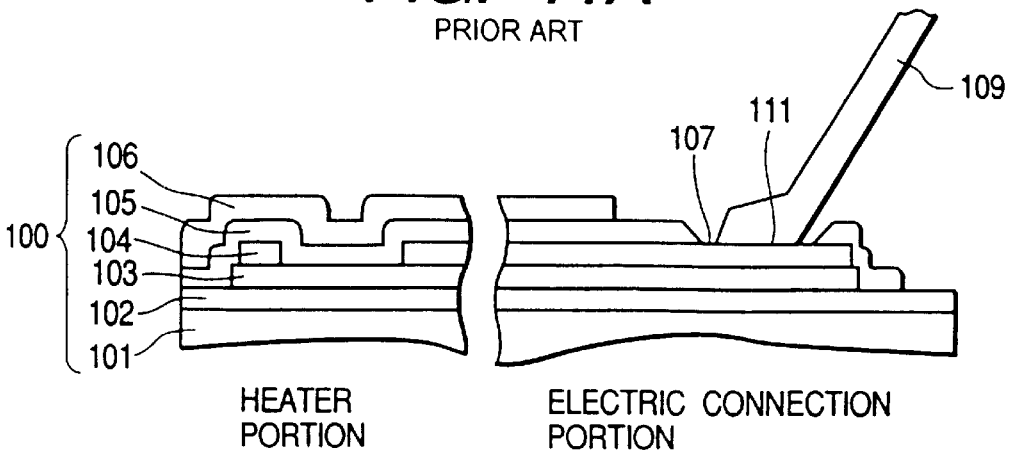
FIG. 11A PRIOR ART
FIGS. 11A and 11B are respectively a cross-sectional view and a plan view showing the film configuration of a conventional ink jet recording head.
Figure 11B:
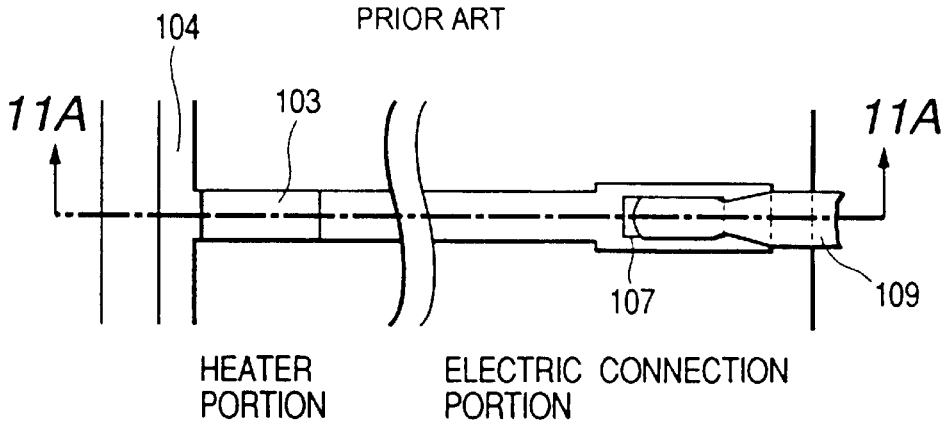
FIG. 11B PRIOR ART
Figure 12A:
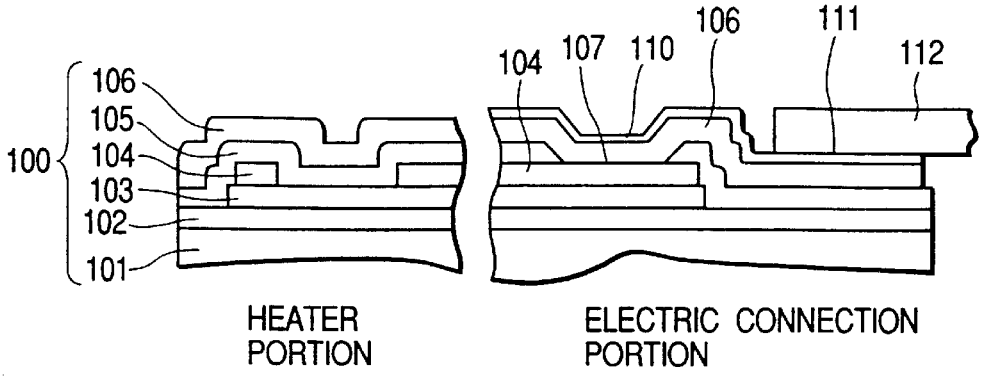
FIG. 12A PRIOR ART
FIGS. 12A and 12B are respectively a cross-sectional view and a plan view showing the film configuration of another conventional ink jet recording head.
Figure 12B:
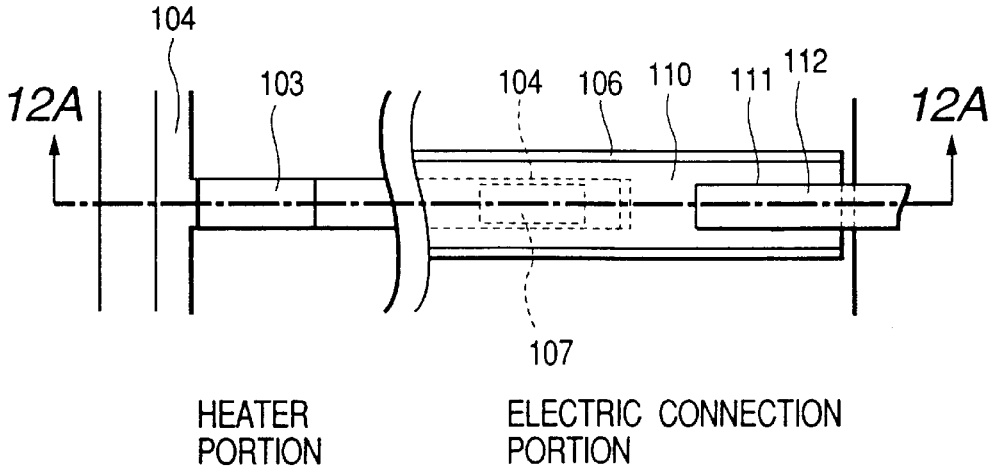
FIG. 12B PRIOR ART

FIG. 10 is an external perspective view of an ink jet apparatus (IJA) in which an ink jet head embodying the present invention is mounted as an ink jet head cartridge (IJC).

In FIG. 10, an ink jet cartridge (IJC) 20 is provided with a group of nozzles for discharging ink to the recording surface of the recording sheet transported onto a platen 24. A carriage HC 16 supporting the IJC 20 is connected in a part of a driving belt 18 transmitting the driving power of a motor 17 and is rendered slidably movable along two mutually parallel guide shafts 19A, 19B thereby enabling reciprocating motion of the IJC 20 over the entire width of the recording sheet.

A blade 30 composed of silicone rubber is provided as a wiring member on a lateral face of a head recovery device 26. The blade 30 is supported with a cantilever mechanism by a blade support member 30A and is driven, like the head recovery device 26, by a motor 22 and an electrically driven mechanism 23 to be coupled with the ink discharging face of the IJC 20. Thus the blade 30 is made to protrude in the moving path of the IJC 20, at a suitable timing in the course of the recording operation of the IJC 20 or after a discharge recovering operation by the head recovery device 26, thereby wiping off condensation, liquid, dust or the like on the ink discharging face of the IJC 20 along with the movement thereof.

According to the present invention, as explained in the foregoing, since the electroless plated film constituting the external electrical connection portion grows only from a portion exposed in the contact hole, the surface of the obtained electroless plated film does not become concave but provides a flat surface area, whereby the reliability of jointing to the external wiring is improved in the ink jet recording head.

Such configuration can also be applied to a small-sized ink jet recording head, since the external electrical connection portion need not be extended.

Also the presence of a projection between the external electrical connection portion and the end face of the substrate avoids contact between the TAB lead and the substrate, thereby eliminating the electrical leak to the substrate.

Furthermore, the gold layer required for adhering the TAB tape can be formed with a single plating apparatus, without expensive apparatus such as the sputtering apparatus or the patterning line.

Furthermore, the ink jet recording head can be provided very inexpensively, because a large amount of heads can be processed at a time without the mask or the sputtering target.

TABLE 1

| Method for eliminating pinholes in protective film | Abnormality after plating presence/absence and rate of occurrence |
|---|---|
| (1) Anodizing | |
| 1. Anodizing of wiring layer | none (0/200 chips = 0%) |
| 2. Anodizing of cavitation layer | none (0/200 chips = 0%) |
| (2) Multi-layered protective film | |
| 1. Three-layered (silicon dioxide, silicon nitride and silicon carbide) | none (0/200 chips = 0%) |
| 2. Two-layered (silicon dioxide and silicon nitride) | none (0/200 chips = 0%) |
| 3. Two-layered (silicon nitride and silicon carbide) | none (0/200 chips = 0%) |
| (3) Organic film on inorganic film | |
| 1. Organic film on silicon dioxide | none (0/200 chips = 0%) |
| 2. Organic film on silicon nitride | none (0/200 chips = 0%) |
| (4) Tickness change of protective film | |
| Film thickness = 0.7 μm | present (4/200 chips = 2%) |
| Film thickness = 0.8 μm | none (0/200 chips = 0%) |
| Film thickness = 0.9 μm | none (0/200 chips = 0%) |
| Film thickness = 1.0 μm | none (0/200 chips = 0%) |
| Film thickness = 1.1 μm | none (0/200 chips = 0%) |
| Film thickness = 1.2 μm | none (0/200 chips = 0%) |

What is claimed is:

1. A method for producing an ink jet recording head comprising a heat-generating resistance layer formed on a substrate for generating thermal energy used for ink discharge, a wiring electrode layer electrically connected to the heat-generating resistance layer to form an electrothermal converting element, an insulating protective layer covering the electrothermal converting element, and an external electrical connection portion electrically connected to the electrothermal converting element and configured to connect to an external wiring for applying a voltage to the electrothermal converting element, the method comprising steps of:

forming a through hole in the insulating protective layer;

exposing a portion of the wiring electrode layer; and growing a layer by electroless plating from the exposed portion of the wiring electrode layer to form the external electrical connection portion, wherein the external electrical connection portion projects beyond the insulating protective layer and has a central flat surface at a most extended projection of the external electrical connection portion, the central flat surface being formed opposite the exposed portion of the wiring electrode layer.

2. A method for producing an ink jet recording head according to claim 1, wherein the external electrical connection portion is composed of plural layers which consist of a gold layer on top of a nickel layer.

3. A method for producing an ink jet recording head according to claim 2, wherein the gold layer on the nickel layer has a thickness equal to at least 0.1 μm.

4. A method for producing an ink jet recording head according to claim 1, wherein the external electrical connection portion is composed of plural layers which consist of a gold-2 layer, on top of a gold-1 layer, on top of a nickel layer.

5. A method for producing an ink jet recording head according to claim 4, wherein the gold-2 layer and the gold-1 layer on the nickel layer have a combined thickness equal to at least 0.1 $\mu$m.

6. A method for producing an ink jet recording head according to claim 1, wherein the head further comprises an anticavitation Ta layer on the insulating protective layer, wherein the Ta layer is not formed on the external electrical connection portion.

7. A method for producing an ink jet recording head according to claim 6, wherein the step of forming the external electrical connection portion by electroless plating is conducted after forming the Ta layer and anodizing the surface thereof.

8. A method for producing an ink jet recording head according to claim 1, wherein the wiring electrode layer is composed of aluminum or an aluminum alloy.

9. A method for producing an ink jet recording head according to claim 8, wherein the aluminum alloy is any of aluminum and silicon, aluminum and copper, or aluminum, silicon and copper.

10. A method for producing an ink jet recording head according to claim 1, wherein the step of forming the external electrical connection portion by electroless plating is conducted after a photosensitive resin layer constituting a liquid path wall is formed on the insulating protective layer.

11. A method for producing an ink jet recording head according to claim 1, wherein the external wiring is a TAB tape.

12. A method for producing an ink jet recording head according to claim 11, wherein the substrate has a projection between the external electrical connection portion and an end portion of the substrate.

13. A method for producing an ink jet recording head according to claim 12, wherein the projection is formed of a photosensitive resin.

14. A method for producing an ink jet recording head according to claim 13, wherein the projection is formed simultaneously with a photosensitive resin layer constituting a liquid path wall.

* * * * *